US009077133B2

(12) United States Patent
Wallace

(10) Patent No.: US 9,077,133 B2
(45) Date of Patent: Jul. 7, 2015

(54) MULTI-POSITION DUCKHEAD ADAPTER PLUGS AND ASSOCIATED MOVEABLE PLUG ASSEMBLIES

(71) Applicant: Donald L. Wallace, Temple, TX (US)

(72) Inventor: Donald L. Wallace, Temple, TX (US)

(73) Assignee: Dell Products LP, Round Rock, TX (US)

( * ) Notice: Subject to any disclaimer, the term of this patent is extended or adjusted under 35 U.S.C. 154(b) by 124 days.

(21) Appl. No.: 13/771,611

(22) Filed: Feb. 20, 2013

(65) Prior Publication Data

US 2014/0235079 A1 Aug. 21, 2014

(51) Int. Cl.

| | |
|---|---|
| ***H01R 13/44*** | (2006.01) |
| ***H01R 13/60*** | (2006.01) |
| ***H01R 35/04*** | (2006.01) |
| *H01R 103/00* | (2006.01) |
| *H01R 24/28* | (2011.01) |

(52) U.S. Cl.

CPC ..... *H01R 35/04* (2013.01); *H01R 2103/00* (2013.01); *H01R 24/28* (2013.01)

(58) Field of Classification Search

CPC ..... H01R 35/04
USPC ..... 439/11, 13, 29, 31, 131, 164, 165, 52, 439/151, 640
See application file for complete search history.

(56) References Cited

U.S. PATENT DOCUMENTS

| | | | | |
|---|---|---|---|---|
| 2,305,101 | A * | 12/1942 | O'Brien | 439/31 |
| 5,628,641 | A | 5/1997 | Hahn | |
| 6,275,002 | B1 * | 8/2001 | Chen | 439/131 |
| 6,454,578 | B1 * | 9/2002 | Yao | 439/131 |
| 6,494,727 | B2 * | 12/2002 | Wen-Ching | 439/131 |
| 6,544,051 | B1 * | 4/2003 | Su | 439/131 |
| 6,786,743 | B2 * | 9/2004 | Huang | 439/31 |
| 6,821,134 | B2 | 11/2004 | Chen | |
| 6,840,784 | B2 * | 1/2005 | Chang | 439/131 |
| 7,104,813 | B1 * | 9/2006 | Chuang | 439/131 |
| 7,125,266 | B1 * | 10/2006 | Huang | 439/131 |
| 7,156,673 | B2 * | 1/2007 | Son | 439/131 |
| 7,287,991 | B1 * | 10/2007 | Li | 439/131 |
| 7,484,972 | B1 * | 2/2009 | Kuo et al. | 439/131 |
| 7,658,625 | B2 | 2/2010 | Jubelirer et al. | |

(Continued)

OTHER PUBLICATIONS

Phihong, "10 Watt Adapter-Compact Shirt Pocket Sizse PSA10A Flip Plug Series", Printed from Internet on Jan. 30, 2013, 2 pgs.

(Continued)

*Primary Examiner* — Felix O Figueroa
(74) *Attorney, Agent, or Firm* — Egan, Peterman & Enders LLP.

(57) ABSTRACT

Multi-position duckhead adapter plugs and associated moveable plug assemblies are disclosed that may be provided, for example, to couple an electrically powered device such as an information handling system to an AC mains power receptacle. A multi-position duckhead adapter plug may utilize electrically-conductive prongs configured and dimensioned for insertion into corresponding electrically-conducive sockets of a plug receptacle. The electrically-conductive prongs of an adapter plug may be mounted in a moveable plug assembly that is at least partially spherical and that is rotatably received in a stationary adapter housing. The moveable plug assembly may include one or more electrical contact detents and/or locking detents for effecting electrical interconnection and/or adjustable locking positioning within the stationary adapter housing.

23 Claims, 7 Drawing Sheets

(56) References Cited

U.S. PATENT DOCUMENTS

| | | | | |
|---|---|---|---|---|
| 8,089,244 | B2 * | 1/2012 | Zhang et al. | 439/131 |
| 8,182,274 | B1 * | 5/2012 | Cheng et al. | 439/131 |

OTHER PUBLICATIONS

AC Adapters Reviews, Product Description, Conntek 30001 Traveler Male Plug Adapter U.S. Male Plug to Laptop/Power Adapter IEC C7 Female Connector Reviews, Printed from Internet on Nov. 6, 2012, 3 pgs.

Kamis, Inexpensive Apple Mac AC Power Adapter US Wall Plug Duck Head for iBook/iPhone/IPod, Feb. 3, 2011, Printed from Internet on Nov. 5, 2012, 5 pgs.

Welshin Duckheads, Publically available prior the to the filing date of the present patent application, 1 pg, Nov. 8, 2012.

Hot Products, Electronic Products, Printed from Internet on Nov. 8, 2012, 2 pgs.

Well Shin Technology, Products, Printed from Internet on Nov. 8, 2012, 2 pgs.

Cordtec, Power-Con Shack, Products, Printed from Internet on Nov. 8, 2012, 2 pgs.

* cited by examiner

MULTI-POSITION DUCKHEAD ADAPTER PLUGS AND ASSOCIATED MOVEABLE PLUG ASSEMBLIES

FIELD OF THE INVENTION

This application relates to adapter plugs, and more particularly to duckhead adapter plugs.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

AC power adapter plugs are often employed to couple an AC mains power receptacle to provide power to an information handling system or other type of electrically powered device. Such AC power adapter plugs are often provided with power prongs that are configured and dimensioned for insertion into corresponding connector openings (slots or sockets) of an AC wall power receptacle. An AC power adapter plug may or may not include internal power conversion circuitry, e.g., such as AC to universal serial bus (USB) power conversion circuitry that converts AC mains power to appropriate DC power for powering an information handling system or other electrical device. Some AC power adapter plugs are configured simply as a power plug for coupling to separate AC to DC power conversion circuitry or to provide unconverted AC mains power to an information handling system or other electrical device.

Most conventional duckhead adapters are configured either as a fixed single position assembly or as a two position assembly having single axis movement. Such conventional AC power duckhead adapter plugs are typically configured as a two or three position plug assembly that includes a stationary housing containing a movable plug portion having a nonconductive cross bar and two metal power prongs that are configured to be received in respective corresponding openings of an AC wall power receptacle. The movable plug portion may be movable together with its power prongs between two or three different positions (such as storage and deployed prong positions). In such a conventional adapter plug assembly, contact between the movable power prongs and internal contacts of the stationary housing is typically not very robust and the mechanical movement of the plug portion is typically rough and awkward. Such conventional configurations also typically experience excessive wear of metal-to-metal contacts between the stationary and movable portions of the plug assembly. Some conventional plug designs also have openings or slots into which small metal objects can fall.

SUMMARY OF THE INVENTION

Multi-position duckhead adapter plugs and associated moveable plug assemblies are disclosed herein that are provided for coupling an electrically powered device such as an information handling system to an AC mains power receptacle or other type of electrical receptacle. As disclosed herein, a multi-position duckhead adapter plug may utilize electrically-conductive prongs configured and dimensioned for insertion into corresponding electrically-conductive sockets (connectors) of an electrical receptacle. In one exemplary embodiment, a multi-position duckhead AC adapter power plug may be configured with conductive power prongs for insertion into respective electrically-conductive sockets of an AC mains power receptacle to electrically connect AC mains power to an AC adapter power plug. Such an AC adapter power plug may in turn be configured for electrical coupling to an electrically powered device, e.g., by electrical conductors of a power cable. The conductive power prongs of the adapter plug may be mounted in a moveable plug assembly that is at least partially spherical (e.g., semi-spherical, completely spherical, ball-shaped, etc.) and that is rotatably received in a stationary adapter housing.

As further disclosed herein, the movable plug assembly of an adapter plug may be provided with multiple detents that are configured as electrically conductive features and/or as locking features on an external substantially spherical surface of the at least partially spherical moveable plug assembly. In this regard, detents may be provided for purposes of locking the moveable plug assembly in different positions relative to the stationary housing and/or for purposes of making electrical contact with corresponding conductive and/or locking features or (e.g., resilient locking features) of the stationary housing. In one exemplary embodiment, plug assembly detents may be optionally configured as conductive support features that are configured to mate with corresponding mating housing conductive support features in order to rotatably support the movable plug assembly within a cavity of a stationary adapter housing. In another exemplary embodiment, plug assembly detents may be provided that are configured to mate with one or more corresponding mating housing locking features (e.g., resilient locking features) provided within a stationary adapter housing cavity.

Shape and size of locking detents provided on a movable plug assembly may be of any size and or shape (i.e., detent profile) suitable for cooperatively mating with an adapter housing locking feature to lock the moveable plug assembly in one or more positions relative to the stationary housing. Similarly, shape and size of electrical contact detents provided on a movable plug assembly may be of any size and or shape (i.e., detent profile) suitable for cooperatively mating with an adapter housing conductive feature to make an electrical connection between electrically-conductive components of the stationary housing and electrically conductive components of the movable plug assembly. Suitable shapes or detent profiles for locking detents and electrical contact detents include, but are not limited to, spherical, oval, irregular, etc. It is also possible that sizes and/or shapes of different individual locking detents and/or electrical contact detents may vary relative to each other on a given movable plug assembly. Additionally, it is possible that one or more detents on a movable plug assembly may be configured to function as both a locking detent and an electrical contact detent.

In one exemplary embodiment, an at least partially spherical moveable plug assembly may be provided with electrical contact detents that are configured to mate with corresponding stationary housing internal electrical contacts (e.g., electrical pin contacts suspended by electrical contact arms) and locking detents that are configured to mate with resilient locking features (e.g., spring-loaded locking pins) to hold or lock the movable plug assembly in a selected position relative to the stationary adapter housing. The at least partially spherical moveable plug assembly may be further provided with conductive power prongs (e.g., metal power prongs) that are coupled to the electrical contact detents via conductive leads. The conductive power prongs, conductive leads, electrical contact detents, and locking detents may be mounted (e.g., molded, embedded, etc.) into the at least partially spherical body of the moveable plug assembly. The body of the at least partially spherical moveable plug assembly may be constructed of an electrically insulating plastic, for example, a moldable plastic such as thermoset plastic, thermoplastic, etc.

In one embodiment, conductive prongs may be mounted into the body of the moveable plug assembly to provide increased mechanical support for the conductive prongs than is typically possible with conventional moveable plug assembly configurations. In another embodiment, the disclosed at least partially spherical moveable plug assembly may be provided in a configuration that is capable of moving within a stationary plug housing from one plug position to another with greater smoothness than is possible with conventional moveable plug assemblies. This increased smoothness may translate into less wear experienced over time between mating stationary and movable electrical surfaces of the adapter plug, i.e., between the internal contacts of the stationary housing system and the electrical contact detents of the at least partially spherical moveable plug assembly.

In another embodiment, the number and/or configuration (e.g., dimensions and/or shape) of locking detents provided on the surface of an at least partially spherical moveable plug assembly may be varied to selectively increase or decrease the amount of force required to move the moveable plug assembly from one locked position to another within the stationary housing by reducing or increasing the number of provided locking detents. Further, location/s of electrical contact detents provided on the surface of an at least partially spherical moveable plug assembly may be varied as appropriate to fit different given possible implementations and configurations of power prongs within the plug assembly. Configuration of stationary housing internal electrical contacts within the housing (e.g., such as shape of electrical contact arms and corresponding pins) may also be varied to accommodate the desired location/s of electrical contact detents on the surface of the moveable plug assembly. A substantially rectangular prong base may also be provided in one exemplary embodiment to extend outward from the circumferential periphery of an at least partially spherical moveable plug assembly to partially surround and/or at least partially support the power prongs of the moveable plug assembly, and also to function as a guide for the movement of the power prongs relative to the stationary housing. Such a prong base may also be configured in one exemplary embodiment to help minimize any gaps between moving parts of the multi-position duckhead adapter plug.

In one respect, disclosed herein is a multi-position duckhead adapter plug, including a stationary adapter housing having a housing cavity defined therein. The stationary adapter housing may include one or more stationary housing conductive features provided on one or more internal sides of the housing cavity, each one of the housing conductive features being configured for coupling to an electrically-powered device by a respective electrical conductor. The adapter plug may also include a moveable plug assembly rotatably received within the housing cavity of the stationary adapter housing. The moveable plug assembly may include an at least partially spherical plug assembly body, one or more plug assembly conductive electrical contact detents provided on the plug assembly body, and one or more electrically-conductive prongs extending outwardly from the at least partially spherical plug assembly body. Each of the prongs may be electrically coupled to a respective one of the plug assembly conductive electrical contact detents and also be configured and dimensioned for insertion into a corresponding electrically-conductive socket. Each given one of the stationary housing conductive features may be mated with a corresponding one of the plug assembly conductive detents to electrically couple the given one of the stationary housing conductive features to a corresponding one of the prongs.

In another respect, disclosed herein is a moveable plug assembly, including: an at least partially spherical plug assembly body, one or more plug assembly conductive electrical contact detents provided on the plug assembly body, and one or more electrically-conductive prongs extending outwardly from the at least partially spherical plug assembly body. Each of the prongs may be electrically coupled to a respective one of the plug assembly conductive electrical contact detents and may be configured and dimensioned for insertion into a corresponding electrically-conductive socket. The moveable plug assembly may be configured to be rotatably received within a housing cavity of a stationary adapter housing, and each given one of the plug assembly electrical contact detents may be configured to mate with a corresponding stationary housing conductive feature when the movable plug assembly is rotatably received within the housing cavity.

In another respect, disclosed herein is a multi-position duckhead adapter plug, including a stationary adapter housing having a housing cavity defined therein. The stationary adapter housing may include one or more stationary housing conductive features provided on one or more internal sides of the housing cavity, each one of the housing conductive features being configured for coupling to an electrically-powered device by a respective electrical conductor. The stationary adapter housing may also include at least one stationary housing locking feature provided on at least one internal side of the housing cavity. The adapter plug may also include a moveable plug assembly rotatably received within the housing cavity of the stationary adapter housing. The moveable plug assembly may include an at least partially spherical plug assembly body; one or more electrically-conductive prongs extending outwardly from the at least partially spherical plug assembly body, each of the prongs being electrically coupled within the housing cavity to a respective one of the stationary housing conductive features and being configured and dimensioned for insertion into a corresponding electrically-conductive socket; and at least one plug assembly locking detent provided on the plug assembly body. The at least one plug assembly locking detent may be configured to releasably mate with the at least one stationary housing locking feature to releasably lock the moveable plug assembly in at least one pre-determined position within the cavity of the adapter housing.

DESCRIPTION OF ILLUSTRATIVE EMBODIMENTS

Figure 1:
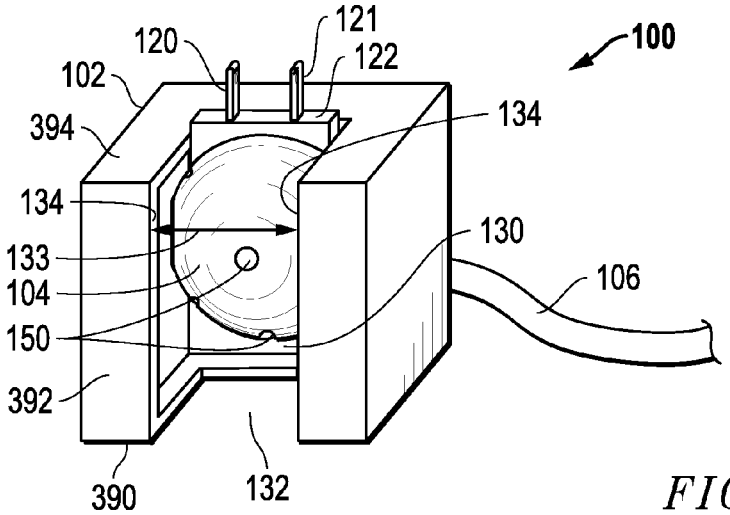
FIG. 1 illustrates a perspective view of a multi-position duckhead adapter plug according to one exemplary embodiment.
Figure 2:
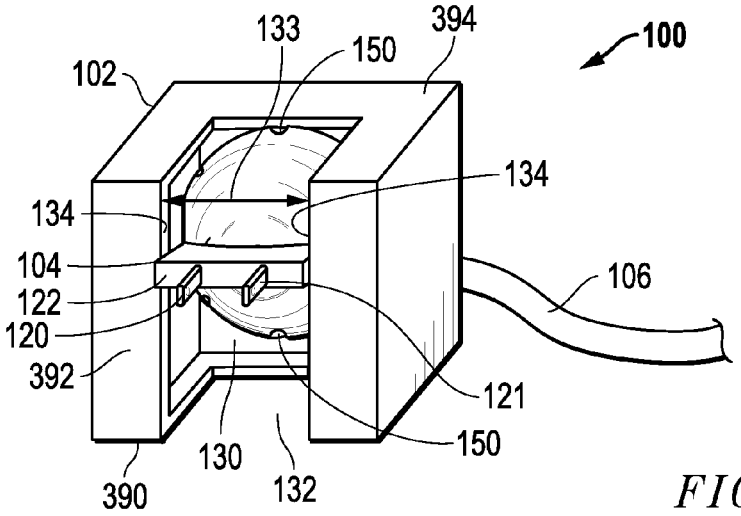
FIG. 2 illustrates a perspective view of a multi-position duckhead adapter plug according to one exemplary embodiment.
Figure 3:
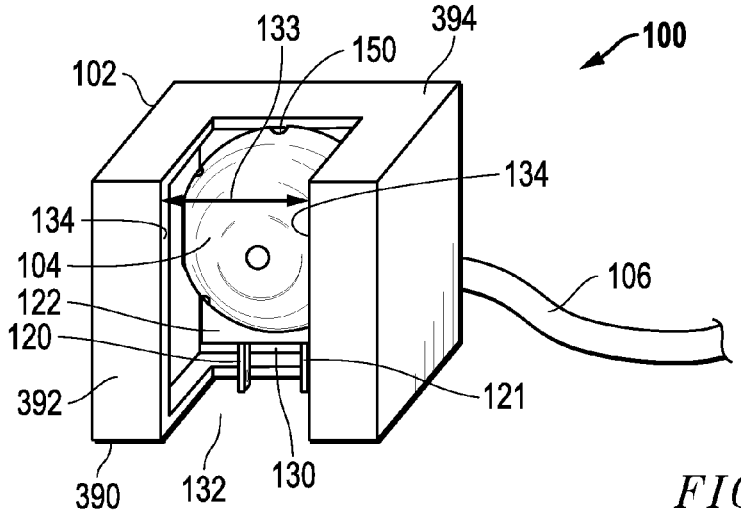
FIG. 3 illustrates a perspective view of a multi-position duckhead adapter plug according to one exemplary embodiment.

FIGS. 1-3 illustrate a multi-position duckhead adapter plug 100 configured in this exemplary embodiment as an AC adapter power plug that includes a movable plug assembly 104 rotatably received within an internal cavity 130 of a stationary adapter housing 102. As shown, a power cord 106 is coupled between stationary adapter housing 102 and an electrically powered device (e.g., such as an information handling system) not shown. In this exemplary embodiment, the body of movable plug assembly 104 is at least partially spherical in shape and may be formed from a single piece of plastic that is molded around electrically conductive metal components that are further described herein, it being understood that the body of a movable plug assembly 104 may alternatively be formed to enclose the electrically conductive metal components of the assembly from two or more assembled pieces of plastic or other suitably electrically insulating material.

As shown in FIG. 1, the movable plug assembly 104 of this embodiment includes two substantially parallel electrically-conductive power prongs 120 and 121 in the form of flattened power blades that extend outward from movable plug assembly 104 in a configuration that is suitable for insertion into a standard 110/120 Volt AC mains wall power socket or slot (not shown), it being understood that a movable plug assembly may be similarly provided with two or more conductive power prongs of alternative configurations (e.g., as cylindrical or rectangular rods or tines, etc.) that are suitable for insertion into other types of wall power socket (e.g., such as 220/240 Volt, etc.). Thus, it will be understood that the following description regarding blades 120 and 121 is exemplary only, and applies equally to other configurations (e.g., shapes and number) of electrically conductive prongs that may be employed.

In the embodiment of FIG. 1, movable plug assembly 104 also includes an optional substantially rectangular prong base 122 that extends from the circumferential periphery of the spherical body of moveable plug assembly 104. Such a prong base 122 may be provided to at least partially surround and/or at least partially support power blades 120 and 121 or other configuration of prongs, as well as to perform functions as described elsewhere herein. It will be understood that a duckhead adapter plug may be alternatively configured in other embodiments for other types of electrical connection applications, e.g., having differing numbers of electrically-conductive blades and/or for conducting different types of electrical power or signals between electrically-conductive sockets and an adapter plug and associated electrical components.

Still referring to the embodiment of FIGS. 1-3, movable plug assembly 104 is configured to rotate selectably between three positions within internal cavity 130 of stationary adapter housing 102, e.g., in response to force applied to blades 120/121 in the desired direction of movement of moveable plug assembly 104 by a human user. A housing channel 133 may be defined to extend from internal housing cavity to the outer periphery of stationary adapter housing 102. Power blades 120/121 may be movably received within housing channel 133 as shown. In this exemplary embodiment, housing channel 133 may have a width (i.e., the distance between opposing walls 134 of channel 133) that is configured to receive optional rectangular prong base 122 in a close-fitting relationship that nonetheless allows for substantially free rotation of movable plug assembly 104 within cavity 130. In this embodiment, such a close fitting relationship between channel walls 134 and prong base 122 acts as a guide for the movement of the power blades relative to the stationary housing, while at the same time providing lateral support to help prevent sideways rotation of movable plug assembly 104 in direction/s that are off axis to the desired axial direction of rotation of movable plug assembly 104 between its three positions (or desired axial directions of rotation in other multi-axis embodiments). As shown, opposing walls 134 of housing channel 133 are configured with a wall thickness that allows blades 120 and 121 to extend beyond the outer periphery dimensions of adapter housing 102 to allow insertion into an AC power receptacle when movable plug assembly 104 is oriented in the 180 degree and 90 degree use positions of FIGS. 1 and 2, respectively.

FIG. 3 shows movable plug assembly 104 in a storage position within stationary adapter housing 102, i.e., in which blades 120 and 121 are contained within (and do not extend beyond) the outer periphery dimensions of a storage end 390 of stationary adapter housing 102. In this regard, an optional storage position cavity 132 may defined as shown adjacent storage end 390 by extended (longer) housing channel walls 134 of channel 133 on one peripheral side of adapter housing cavity 130 corresponding to the storage position for blades 120 and 121 for containing power blades 120 and 121 within housing cavity 130 when moveable plug assembly 104 is in the storage position as shown in FIG. 3. It will be understood that storage position cavity 132 may be open on the storage end 390 as shown, e.g., to allow a user's finger to be inserted the channel 133 from the storage end 390 of stationary adapter housing 102 in order to contact and the blades 120/121 outward to rotate the moveable plug assembly 104 from the storage position into a use position. However in an alternative embodiment, storage end 390 of stationary adapter housing may be closed with one or more blade openings (e.g., two slots) defined in another side (e.g., first use side 392) of stationary adapter housing 102 as illustrated in FIG. 9. In such an alternative embodiment, channel 133 may be wide enough to allow a user's finger to be inserted through the channel 133 (e.g., from either side 392 or 394) in order to contact and directly rotate the moveable plug assembly 104 from the storage position into a use position and vice-versa.

FIGS. 1 and 2 show movable plug assembly 104 in 180 degree and 90 degree use positions, respectively. In each of these use positions, blades 120 and 121 extend outside the peripheral channel walls 134 on one of usage sides 392 or 394 of stationary adapter housing 102 to allow insertion of blades 120 and 121 into corresponding AC mains wall power sockets or slots. As further shown in FIGS. 1-3, plug assembly locking detents 150 are defined on the exterior surface of moveable plug assembly 104 that are configured to mate with resilient adapter housing locking features within stationary adapter housing 102 to hold or lock the movable plug assembly 104 in each of its respective three positions relative to the stationary adapter housing 102. It will be understood that one or more plug assembly locking detents that are configured to mate with one or more adapter housing locking features within stationary adapter housing 102 may be provided in any given embodiment to hold or lock the movable plug assembly 104 in each of its respective three positions relative to the stationary adapter housing 102.

Figure 4:
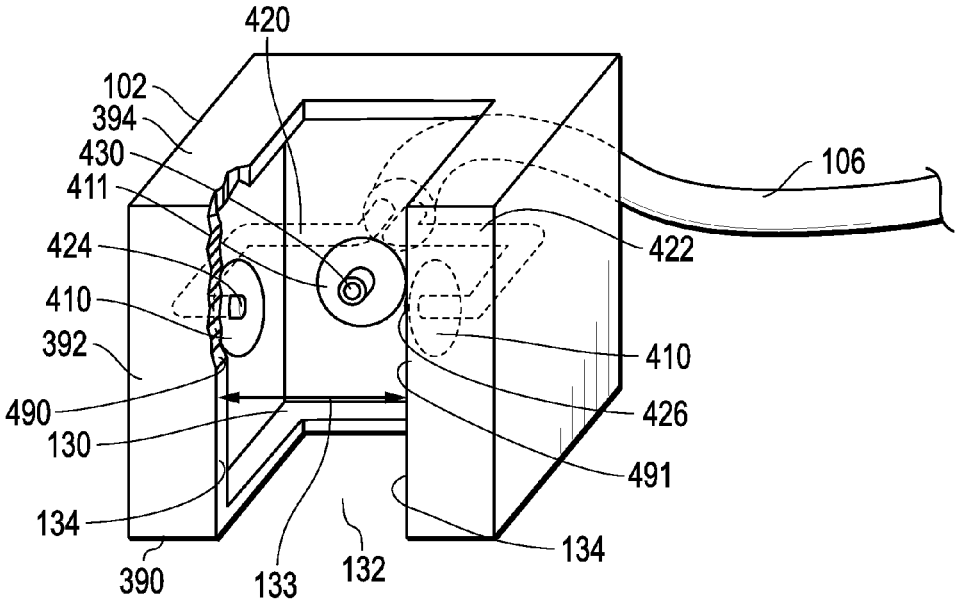
FIG. 4 illustrates a perspective partial cut-away view of a stationary adapter housing according to one exemplary embodiment.
Figure 5:
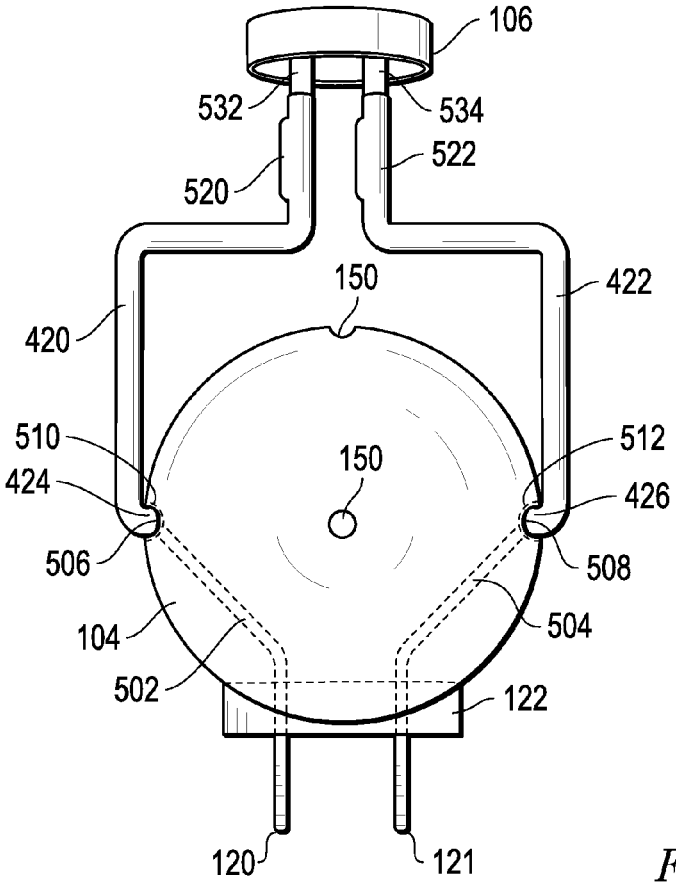
FIG. 5 illustrates the assembled operative relationship between a movable plug assembly and electrical components of a stationary adapter housing according to one exemplary embodiment.

FIG. 4 illustrates a partial cut-away view of stationary adapter housing 102 without moveable plug assembly 104 received therein, and FIG. 5 illustrates the assembled operative relationship between movable plug assembly 104 and electrical components of stationary adapter housing 102 with the adapter housing body removed. As shown in FIG. 4, housing conductive features in the form of two opposing housing internal electrical contacts 424 and 426 extend from opposing internal sides of adapter housing cavity 130 in a configuration that is suitable for electrically and mechanically mating with respective electrical contact detents 506 and 508 provided on opposing sides of movable plug assembly 104 as shown in FIG. 5. In this exemplary embodiment, each of housing internal contacts 424 and 426 are configured as an electrical pin contact (e.g., metal contact pin) that is suspended by respective corresponding one of electrical contact arms 420 and 422 (e.g., metal contact arms) as shown in FIG. 5. It will also be understood that one or more plug assembly conductive detents that are configured to electrically mate with one or more adapter housing conductive features within stationary adapter housing 102 may be provided in any given embodiment.

FIG. 4 illustrates with hidden lines how electrical contact arms 420 and 422 may be embedded (or molded within) within the body of adapter housing 102 such that each of the electrical pin contacts of internal contacts 424 and 426 extend inwardly into cavity 130 from one of opposing internal sidewalls 490 in position for electrically and mechanically mating with a corresponding one of electrical contact detents 506 or 508 of movable plug assembly 104. It will be understood that electrical contact detents may in one embodiment be optionally configured as plug assembly conductive support features, in which case each of the electrical pin contacts of internal contacts 424 and 426 extend inwardly into cavity 130 from one of opposing internal sidewalls 490 as corresponding housing conductive support features in position for electrically and mechanically mating with a corresponding one of electrical contact detents 506 or 508 of movable plug assembly 104 that also support movable plug assembly 104 in rotatable position around an axis extending between internal contacts 424 and 426 within cavity 130. FIG. 5 also illustrates how electrical contact arm 420 may be coupled at a first terminal 520 to a first power conductor 532 (e.g., line conductor) of power cord 106 and how electrical contact arm 422 may be coupled at a second terminal 522 to a second power conductor 534 (e.g., neutral conductor) of power cord 106. Power cord 106 may itself be embedded or molded into the backside of stationary adapter housing 102 together with power conductors 532 and 534.

As further shown in FIG. 4, an optional housing support feature in the form of a semispherical recess 410 may be optionally defined within each of two opposing internal sidewalls 490 of stationary adapter housing 102 to partially receive a portion of the spherical outer surface of movable plug assembly 104. Similarly, a housing support feature in the form of an optional semispherical recess 411 may also or alternatively be optionally defined within the back internal sidewall 491 of stationary adapter housing 102 to partially receive a portion of the spherical outer surface of movable plug assembly 104. Such an optional configuration of recesses 410 and/or 411 may be desirable, e.g., to help provide support and increase structural integrity of the rotatably mounted positional relationship between movable plug assembly 104 and stationary adapter housing 102 when they are assemble together into a multi-position duckhead AC adapter power plug 100. Moreover, it will also be understood that any other suitable configuration of housing support feature/s may be provided that are suitable for supporting rotatably supporting movable plug assembly 104 about one or more desired axes of rotation within stationary adapter housing 102 when they are assemble together into a multi-position duckhead AC adapter power plug 100. As will be further described, a locking feature 411 may be provided for releasably locking moveable plug assembly 104 in different predetermined positions within cavity 103 of adapter housing 102.

Returning to FIG. 5, electrically conductive housing power leads 502 and 504 (e.g., conductive metal) may be embedded or molded into movable plug assembly 104 in a configuration so as to electrically couple power blades 120 and 121 to respective electrical contact detents 506 and 508 provided on opposing sides of movable plug assembly 104. In this regard, each of electrical contact detents 506 and 508 are provided with a concave conductive contact lining (e.g., conductive metal) 510 or 512 that is electrically coupled to respective electrically conductive power leads 502 and 504 (e.g., to form respective line and neutral conductors). Thus, as illustrated in FIG. 5, movable plug assembly 104 may be rotatably supported in cavity 130 of stationary adapter housing 102 between internal contacts 424 and 426 which are received within electrical contact detents 510 and 512, respectively. At the same time, electrical connection is made between internal contacts 424 and 426 and respective electrical contact detents 510 and 512 so as to electrically couple power conductors 532 and 534 to power blades 120 and 121, respectively, while movable plug assembly 104 rotates within cavity 130 of stationary adapter housing 102.

Figure 6:
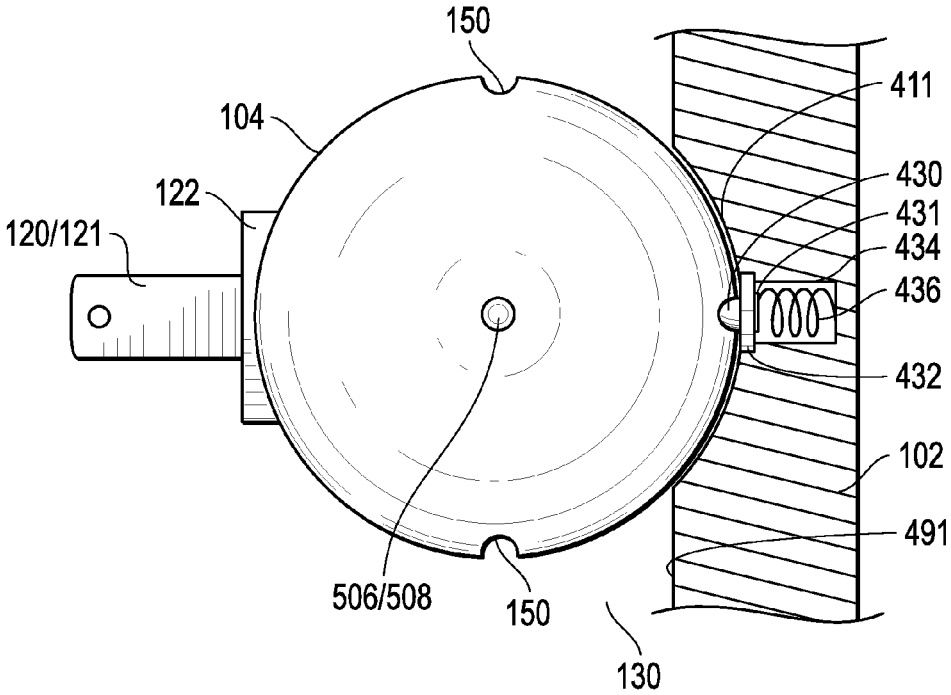
FIG. 6 illustrates a partial cut-away side view of a movable plug assembly stationary adapter housing according to one exemplary embodiment.
Figure 7:
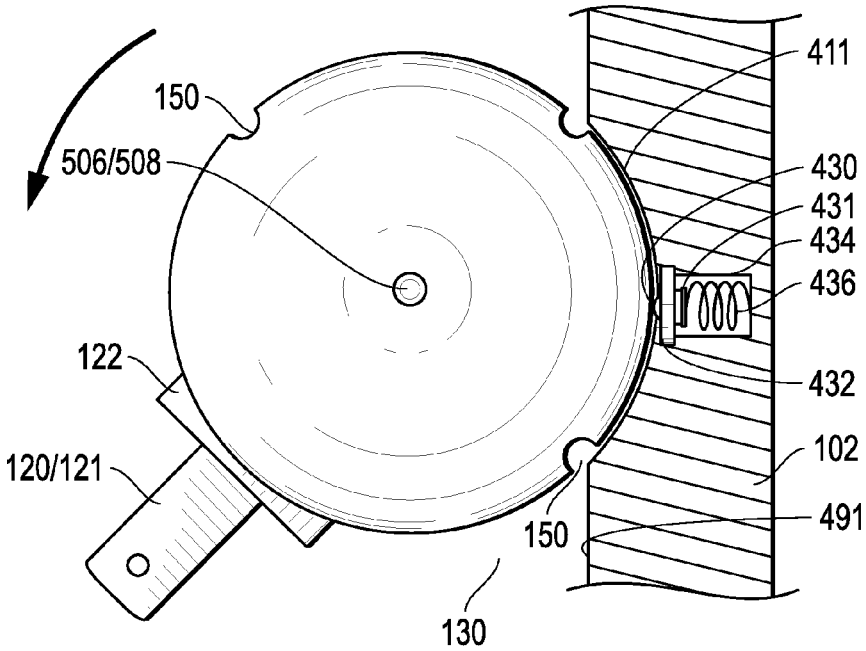
FIG. 7 illustrates a partial cut-away side view of a movable plug assembly stationary adapter housing according to one exemplary embodiment.

FIGS. 6 and 7 illustrate partial cut-away side views of movable plug assembly 104 as it may be received in cavity 103 against the back internal wall 491 of stationary adapter housing 102. FIGS. 6 and 7 show movable plug assembly 104 from the side with stationary adapter housing 102 cut-away to show a cross-sectional view of a resilient locking feature that in this embodiment includes a rounded spring-loaded locking pin 430 configured to be resiliently received in locking detents 150 as shown to lock movable plug assembly 104 in a given position. In this regard, FIG. 6 shows movable plug assembly 104 locked in a 90 degree use position such as illustrated in FIG. 2. In the illustrated embodiment, locking pin 430 is resiliently biased toward movable plug assembly by compression of coil spring 436 within a spring well 434 that is defined within the back internal wall 491. A bushing 432 may be mechanically coupled to the back internal wall 491 to contain spring 436 and locking pin 430 in assembled engagement with spring well 436. In this regard, locking pin 430 may include a circular collar 431 that serves to prevent locking pin 430 from being expelled out of spring well 434 by spring 436. FIG. 7 shows how rotation of moveable plug assembly (e.g., caused by downward force applied to blades 120/121 by a human user) causes movement of locking detent 150 out of aligned position with locking pin 430 so as to mechanically displace resilient locking pin 430 together with its collar 431 inward into spring well 434 against spring 436 so as to allow moveable plug assembly 104 to be rotated to another position, e.g., in this case rotated from 90 degree use position toward storage position such as illustrated in FIG. 3. When the next locking detent 150 becomes aligned with resilient locking pin 430, spring 436 biases locking pin 430 into locking engagement with the new locking detent 150 to lock moveable plug assembly 104 into a new position.

It will be understood that the embodiment of FIGS. 6 and 7 is exemplary only, and that a resilient locking feature may be of any other configuration and/or materials suitable for mating with locking detents 150 of movable plug assembly 104 to releasably lock moveable plug assembly 104 in different positions within stationary adapter housing 102. For example, a resilient locking feature may alternatively be a nipple of resilient material (e.g., such as rubber, polymer, etc.) that is mechanically coupled to the internal back wall 491 of adapter housing 102 in a position similar to locking pin 430, and with a dimensional configuration suitable for being received within locking detents 150.

Figure 8A:
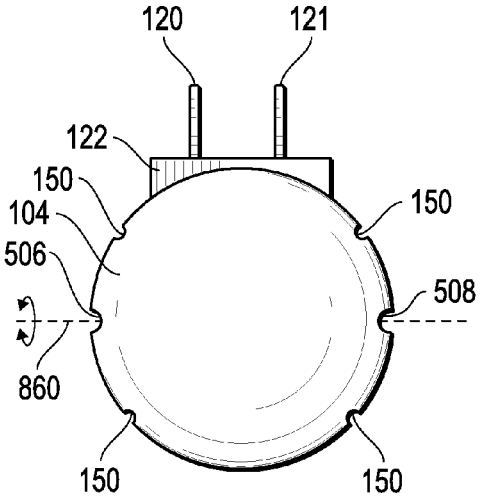
FIGS. 8A-8D illustrate multiple views of a moveable plug assembly according to one exemplary embodiment.
Figure 8B:
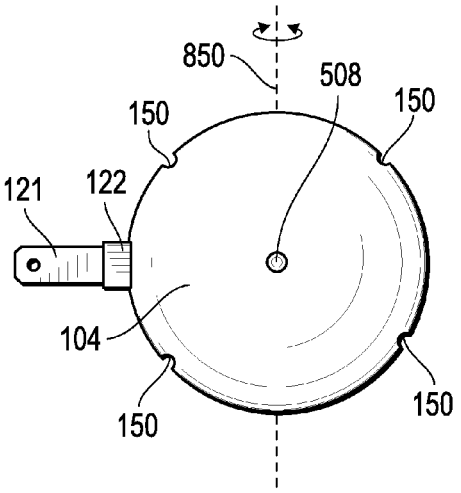
Figure 8C:
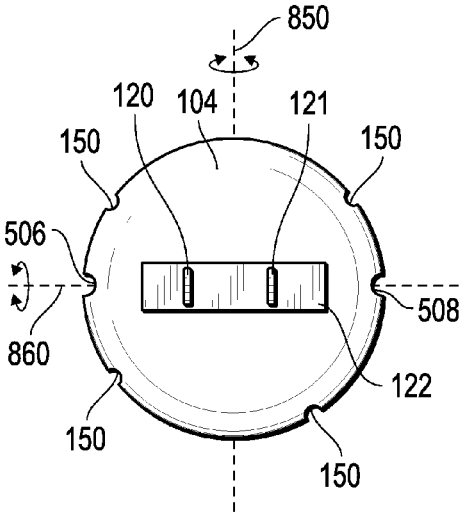
Figure 8D:
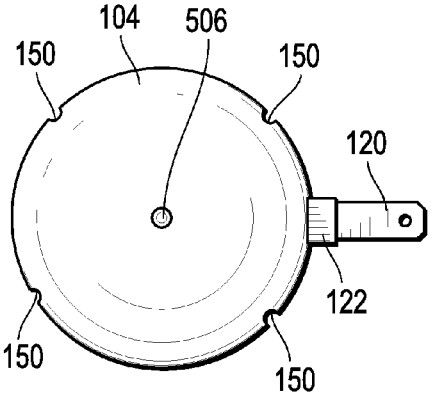
Figure 9A:
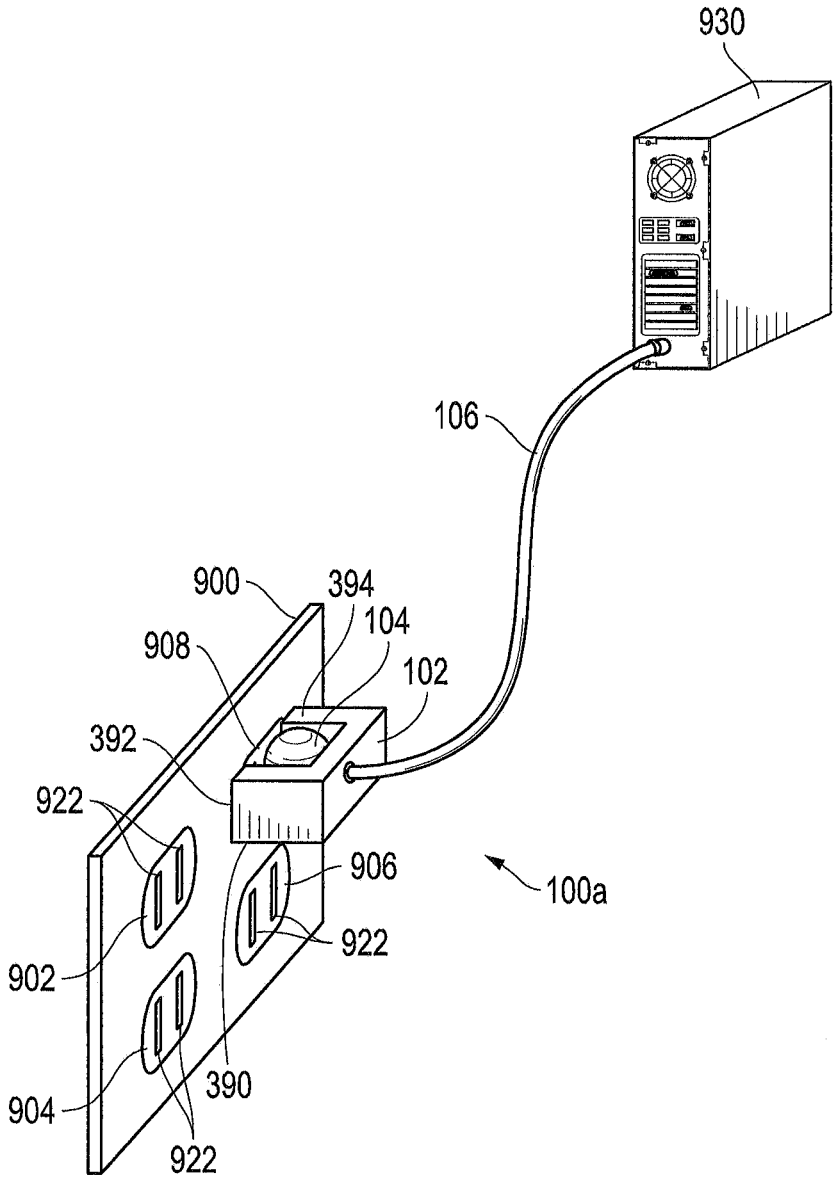
FIG. 9A illustrates a perspective view of different multi-position duckhead Adapter plugs according to different exemplary embodiments.
Figure 9B:
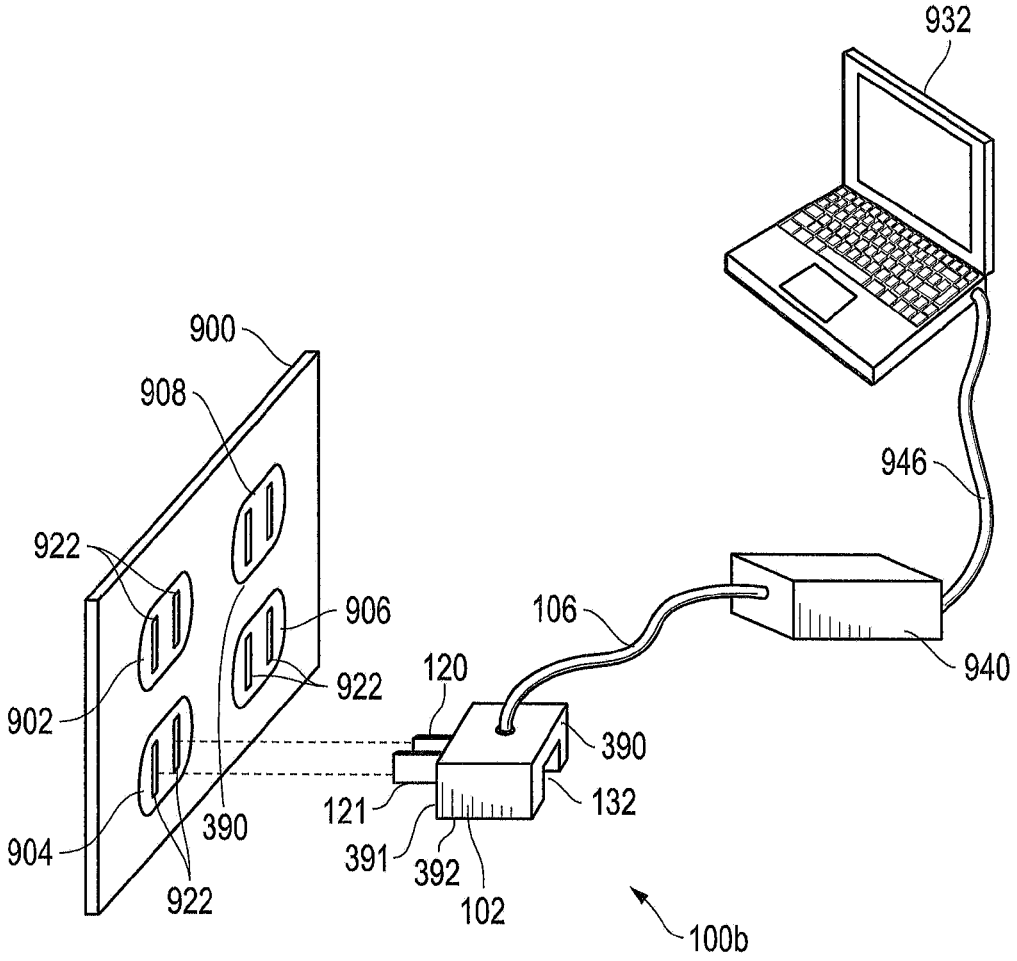
FIG. 9B illustrates a perspective view of different multi-position duckhead Adapter plugs according to different exemplary embodiments.
Figure 9C:
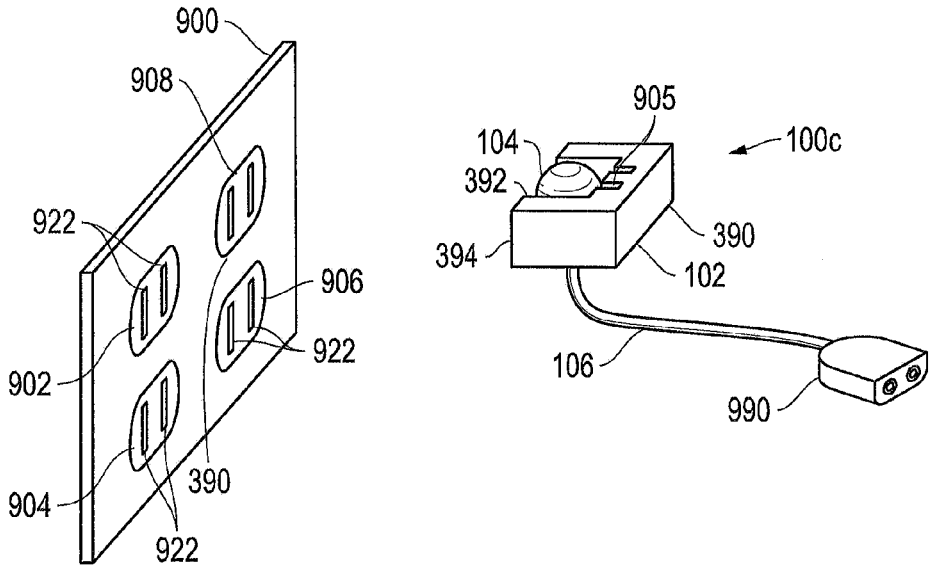
FIG. 9C illustrates a perspective view of different multi-position duckhead Adapter plugs according to different exemplary embodiments.
Figure 9D:
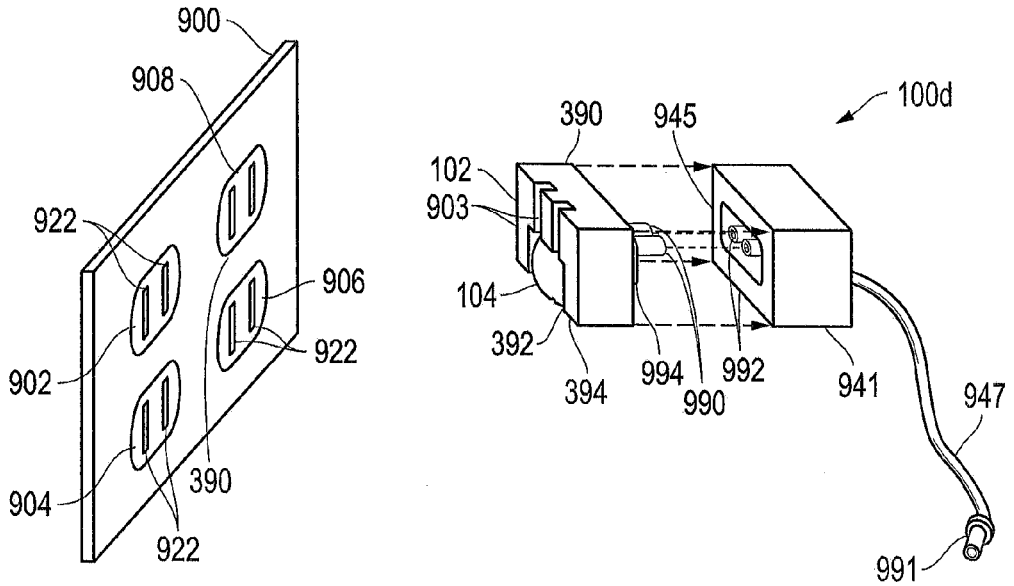
FIG. 9D illustrates a perspective view of different multi-position duckhead Adapter plugs according to different exemplary embodiments.

It will be understood that the particular embodiments of a multi-position duckhead AC adapter power plug 100 and components thereof illustrated herein with respect to FIGS. 1-7 are exemplary only, and that a multi-position duckhead AC adapter power plug may be alternatively provided in any other suitable configuration using a movable plug assembly received within a stationary adapter housing to provide a duckhead adapter having two or more multiple positions, e.g., having fewer or additional locking detents, having fewer or additional electrical contact detents, having different range/s and/or direction/s of motion within a stationary adapter housing, having multiple axes of rotation, etc. In this regard, FIG. 8 illustrates views from four sides of one embodiment of a moveable plug assembly 104 showing how multiple locking detents may be defined in the outer surface of a moveable plug assembly 104 to achieve any desired number of possible locking positions for plug assembly 104 within a stationary adapter housing 102. In particular, the multiple detents of the exemplary embodiment of movable plug assembly 104 of FIGS. 8A-8D provide this embodiment of plug assembly with capability for rotation within a cavity of a stationary adapter housing in multiple axes as shown, i.e., around a first axis 850 between a storage position of FIG. 8B and a 90 degree use position of FIG. 8C, and also around a second axis 860 (perpendicular to the first axis) between 90 degree use position of FIG. 8C and 180 degree use position of FIG. 8A. It will be understood that a correspondingly dimensioned optional L-shaped housing channel may be provided to guide prong base 122 of the embodiment of FIGS. 8A-8D in each of the two directions, i.e., a housing channel may have intersecting horizontal and vertical channel sections within which prong base 122 may rotate in a horizontal direction (relative to the illustrated page) about axis 850 between the illustrated storage position of FIG. 8B to the 90 degree use position of FIG. 8C, and then rotate in a vertical direction (relative to the illustrated page) about axis 860 between the 90 degree use position of FIG. 8C and the 180 degree use position of FIG. 8A, and vice-versa. FIG. 8D shows an opposing view of moveable plug assembly 104 of this embodiment for illustration purposes only.

It will also be understood that one or more plug assembly electrical contact detents (e.g., similar to electrical contact detents 506/508) may be provided in any number or position on the outer surface of a moveable plug assembly 104 that is suitable for implementing a given configuration of power blades 120/121 within a moveable plug assembly 104. The shape and/or location of one or more corresponding stationary housing electrically conductive features (e.g., electrical contact arms 420 and 422) of a given embodiment may also be varied to accommodate a given desired location or locations for corresponding plug assembly electrical contact detents on a plug assembly 104. In this regard, it is possible that additional or duplicate sets of plug assembly electrical contact detents and/or stationary housing conductive features may be configured in order to allow additional range and/or direction of movement of moveable plug assembly 104 within cavity 130 of stationary adapter housing 102 while also maintaining electrical contact in various positions of movable plug assembly 104 within stationary adapter housing 102.

Further, each power blade 120 or 121 may be electrically coupled to more than one plug assembly electrical contact detent on a plug assembly 104, e.g., by multiple sets of power leads such that blades 120 and 121 may make electrical contact to corresponding stationary housing conductive features through different sets of stationary housing conductive features depending on the current position of moveable plug assembly 104 within cavity 130 of stationary adapter housing 102. Additionally or alternatively, each conductor 532 and 534 of a power cord may be electrically coupled to more than one stationary housing conductive feature, e.g., by multiple sets of electrical contact arms such that conductors 532 and 534 may make electrical contact to corresponding stationary housing conductive features through different sets of plug assembly electrical contact detents depending on the current position of moveable plug assembly 104 within cavity 130 of stationary adapter housing 102. Thus, in some embodiments it is possible in some embodiments that a moveable plug assembly electrical contact detent may be repositionable so as to allow for different combinations of electrically mated stationary housing conductive features with the moveable plug assembly electrical contact detent to exist for different corresponding positions of moveable plug assembly 104 within cavity 130 of stationary adapter housing 102, e.g., such as the storage, 90 degree use, and 180 degree use positions of FIGS. 8A-8C.

FIG. 9 illustrates four different multi-position duckhead AC adapter power plugs 100*a*, 100*b*, 100*c*, and 100*d* positioned adjacent an AC power receptacle 900 according to different exemplary embodiments. As shown, AC power receptacle 900 is provided with four pairs 902, 904, 906 and 908 of parallel conductive power slots 922, although it will be understood that the disclosed multi-position duckhead AC adapter power plugs may be suitably configured for use with any other power slot configuration/s. In FIG. 9, moveable plug assembly 104 of AC adapter power plug 100*a* has been rotated to extend its corresponding power blades 120/121 outside the periphery of first use side 392 of adapter housing 102 which are received into corresponding pair 908 of AC power slots 922 to electrically couple the AC mains power supply to an electrically powered device in the form of an information handling system 930 (e.g., desktop computer) via electrical conductors of AC power cord 106.

Still referring to FIG. 9, movable plug assembly 104 of AC adapter power plug 100*b* has been rotated to extend its corresponding power blades 120/121 outside the periphery of second use side 394 of adapter housing 102 in preparation for insertion into corresponding pair 904 of AC power slots 922 to electrically couple the AC mains power supply via AC power cord 106 to an electrically powered device in the form of an AC adapter 940 configured to power a portable information handling system (e.g., laptop computer 932) via DC power provide through electrical conductors of DC power cord 946. As shown, storage position cavity 132 of storage end 390 of AC adapter power plug 100*b* is open in a manner previously described. Meanwhile, movable plug assembly 104 of AC adapter power plug 100*c* is shown rotated to storage position with its power blades 120/121 received in closed-end storage slots 905 as shown. In this regard, storage end 390 of stationary adapter housing 102 of AC adapter power plug 100*c* is closed in a manner as previously described. In this embodiment, a terminal end of AC power cord 106 of AC adapter power plug 100*c* is provided with a removable AC power jack 990 for removable insertion into a corresponding electrically powered device.

Also shown in FIG. 9 is an adapter power plug 100*d* that may be mechanically attached to (or integrated together) with an AC adapter circuitry housing 941, e.g., adapter power plug 100*d* may be either integrated within the same one-piece common plastic housing as AC adapter circuitry housing 941, or adapter power plug 100*d* may be electrically and mechanically attached to a separate plastic chassis of AC adapter circuitry housing 941 as shown in FIG. 9 by an integral molded electrical connector assembly that includes mating AC electrical contacts 990 and 992 and resilient mechanical mating retention features 994 and 995 with no power cord or cable directly attached to the adapter power plug 100*d* itself. In the latter case, components of adapter power plug 100*d* may be electrically coupled to AC adapter circuitry within AC adapter circuitry housing 941 by electrical connectors 990 and 992 rather than a power cord, and mating retention feature 994 may hold adapter power plug 100*d* in mated relationship with AC adapter circuitry housing 941 received within opening 945. A mechanical interference fit (e.g., rubber bushing, plastic clip, etc.) may be provided between mating feature 994 and opening 945 in this two-piece scenario to maintain the adapter power plug 100*d* and AC adapter circuitry housing 941 in mechanically coupled relationship. A DC power cord 947 with DC power jack 991 may extend from the AC adapter circuitry housing 941 for connection to an electrical device. Open-ended storage slots 903 are also shown provided for adapter power plug 100*d* for receiving power blades 120/121 when movable plug assembly 104 of AC adapter power plug 100*d* is rotated to storage position as shown.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touch screen and/or a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and methods may be utilized in various combinations and/or independently. Thus the invention is not limited to only those combinations shown herein, but rather may include other combinations.

What is claimed is:

1. A multi-position duckhead adapter plug, comprising:

a stationary adapter housing having a housing cavity defined therein, the stationary adapter housing comprising opposing stationary housing conductive features provided on respective opposing internal side walls of the housing cavity, each one of the housing conductive features being configured for coupling to an electrically-powered device by a respective electrical conductor; and a moveable plug assembly rotatably received within the housing cavity of the stationary adapter housing, the moveable plug assembly comprising:

a ball-shaped plug assembly body constructed of an electrically insulating plastic;

two opposing plug assembly conductive electrical contact detents provided on opposing sides of the ball shape of the plug assembly body to form a plug assembly axis of rotation therebetween;

one or more electrically-conductive prongs extending outwardly from the ball-shaped plug assembly body, each of the prongs being electrically coupled to a respective one of the plug assembly conductive electrical contact detents and being configured and dimensioned for insertion into a corresponding electrically-conductive socket;

where each given one of the stationary housing conductive features is mated with a corresponding one of the plug assembly conductive detents to electrically couple the given one of the stationary housing conductive features to a corresponding one of the prongs.

2. The adapter plug of claim 1, where the stationary adapter housing further comprises at least one stationary housing locking feature provided on a back internal wall of the housing cavity; where the moveable plug assembly further comprises at least one plug assembly locking detent provided on the plug assembly body; and where the at least one plug assembly locking detent is configured to releasably mate with the at least one stationary housing locking feature to releasably lock the moveable plug assembly in at least one predetermined position within the cavity of the adapter housing.

3. The adapter plug of claim 2, where the at least one plug assembly locking detent comprises multiple plug assembly locking detents provided on the plug assembly body, each of the multiple plug assembly locking detents being configured to releasably mate with the at least one stationary housing locking feature to releasably lock the moveable plug assembly in at least one respective different pre-determined position about the plug assembly axis of rotation within the cavity of the adapter housing; and where each of the respective different pre-determined positions within the cavity of the adapter housing is different from each other of the different pre-determined positions within the cavity of the adapter housing.

4. The adapter plug of claim 3, where a first one of the plug assembly locking detents is configured to releasably mate with the at least one stationary housing locking feature to releasably lock the moveable plug assembly in a storage position in which the prongs do not extend beyond an outer periphery of the stationary adapter housing; and where a second one of the plug assembly locking detents is configured to releasably mate with the at least one stationary housing locking feature to releasably lock the moveable plug assembly in a use position in which the prongs extend beyond the outer periphery of the stationary adapter housing.

5. The adapter plug of claim 2, where the one or more stationary housing conductive features comprise two opposing stationary housing internal electrical contacts extending into the housing cavity from opposing internal sidewalls of the housing cavity; where the at least one stationary housing locking feature comprises at least one resilient locking feature extending into the housing cavity from at least one back internal wall of the housing cavity; and where the two opposing plug assembly conductive features comprise two opposing electrical contact detents provided on opposing external surfaces of the plug assembly body.

6. The adapter plug of claim 1, further comprising a semispherical recess defined within each of the two opposing internal sidewalls of the stationary adapter housing that partially receives a portion of a spherical outer surface of the movable plug assembly.

7. The adapter plug of claim 2, further comprising a semispherical recess defined within each of the two opposing internal sidewalls of the stationary adapter housing that partially receives a portion of a spherical outer surface of the movable plug assembly; and a semispherical recess defined within the back internal wall of the stationary adapter housing that partially receives a portion of a spherical outer surface of the movable plug assembly.

8. The adapter plug of claim 1, where the stationary adapter housing comprises two opposing stationary housing conductive features provided on opposing internal sidewalls of the housing cavity, each one of the stationary housing conductive features being configured for coupling to an electrically-powered device by a respective electrical conductor that is a respective power conductor of a power cord for the electrically powered device; and where the moveable plug assembly comprises:

two electrically conductive power prongs extending outwardly from the ball-shaped plug assembly body, each of the power prongs being electrically coupled to a respective one of the opposing plug assembly conductive features and being configured and dimensioned for insertion into a corresponding socket of an alternating current (AC) mains power receptacle;

where each given one of the two opposing stationary housing conductive features is mated with a corresponding one of the two opposing plug assembly conductive detents to electrically couple the given one of the opposing stationary housing conductive features to a corresponding one of the power prongs when the plug assembly body is rotated to different positions about the plug assembly axis of rotation.

9. The adapter plug of claim 8, where each of the two opposing stationary housing conductive features are stationary housing conductive support features; where the two opposing plug assembly conductive detents are conductive support detents; and where each given one of the two opposing stationary housing conductive support features is mated with a corresponding one of the two opposing plug assembly conductive detents to support the moveable plug assembly therebetween about the rotation axis of the movable plug assembly within the stationary adapter housing.

10. The adapter plug of claim 8, where the stationary adapter housing further comprises two opposing electrical contact arms extending into the housing cavity from opposing internal sidewalls of the housing cavity; and where the two opposing stationary housing internal electrical contacts each comprise an electrical pin contact that is suspended by one of the respective opposing electrical contact arms.

11. The adapter plug of claim 1, further comprising a housing channel defined to extend from the internal, housing cavity to an outer periphery of the stationary adapter housing; where the electrically-conductive prongs are movably received within the housing channel; where the housing channel is defined between opposing channel walls; where the opposing channel walls define a storage cavity corresponding to a storage position of the moveable plug assembly in which the prongs do not extend beyond the outer periphery of the stationary adapter housing; where the moveable plug assembly further comprises a rectangular prong base constructed of the electrically insulating plastic of the ball-shaped plug assembly body and extending outward from a circumferential periphery of the ball-shaped moveable plug assembly to surround and support the prongs of the moveable plug assembly at a base of each prong adjacent the ball-shaped plug assembly body, the rectangular prong base extending between and coupling together the respective bases of the electrically-conductive prongs; and where the rectangular prong base is received in the housing channel between the opposing channel walls of the stationary adapter housing in a substantially close-fitting relationship that allows for substantially free rotation of the movable plug assembly about the plug assembly axis of rotation within the housing cavity.

12. The adapter plug of claim 1, where the moveable plug assembly further comprises a rectangular prong base constructed of the electrically insulating plastic of the ball-shaped plug assembly body and extending outward from the circumferential periphery of the ball-shaped moveable plug assembly body to partially surround and support the electrically-conductive prongs of the moveable plug assembly.

13. The adapter plug of claim 12, where each of the electrically-conductive prongs are electrically coupled to a respective one of the plug assembly conductive detents by a respective conductive lead that is embedded or molded within the ball-shaped plug assembly body such that each respective conductive lead extends through and is completely surrounded by the electrically insulating plastic of the rectangular prong base and ball shaped plug assembly body between one of the electrically-conductive prongs and a respective one of the plug assembly conductive detents.

14. The adapter plug of claim 11, where the housing channel has a width that is configured to receive the rectangular prong base within the channel to allow for free rotation of the movable plug assembly within the housing cavity and to act as a guide for the movement of the electrically-conductive prongs together with the rectangular prong base relative to the stationary housing while at the same time providing lateral support to prevent sideways rotation of the movable plug assembly in a direction that is off axis to the plug assembly axis of rotation.

15. The adapter plug of claim 1, where each one of the stationary housing conductive features is coupled to a respective power conductor of a power cord for an electrically powered information handling system.

16. A moveable plug assembly, comprising:

a ball-shaped plug assembly body constructed of a single piece of electrically;

two opposing plug assembly conductive electrical contact detents provided on opposing sides of the ball shape of the plug assembly body to form a plug assembly axis of rotation therebetween; and one or more electrically-conductive prongs extending outwardly from inside the ball-shaped plug assembly body, each of the prongs being electrically coupled to a respective one of the plug assembly conductive electrical contact detents and being configured and dimensioned for insertion into a corresponding electrically-conductive socket;

where the moveable plug assembly is configured to be rotatably received within a housing cavity of a stationary adapter housing;

where each given one of the plug assembly electrical contact detents is configured to mate with a corresponding stationary housing conductive feature when the movable plug assembly is rotatably received within the housing cavity.

17. The moveable plug assembly of claim 16, further comprising at least one plug assembly locking detent provided on the plug assembly body, the at least one plug assembly locking feature is configured to releasably mate with at least one stationary housing locking feature when the movable plug assembly is rotatably received within the housing cavity.

18. The moveable plug assembly of claim 17, where the at least one plug assembly locking detent comprises multiple plug assembly locking detents provided on the external surface of the plug assembly body.

19. The moveable plug assembly of claim 16, further comprising:

two electrically-conductive power prongs extending outwardly from the ball-shaped plug assembly body, each of the power prongs being electrically coupled to a respective one of the opposing plug assembly electrical contact detents and being configured and dimensioned for insertion into a corresponding socket of an AC mains power receptacle, and where each given one of the two opposing plug assembly electrical contact detents is configured to mate with a corresponding stationary housing conductive feature when the movable plug assembly is rotatably received within the housing cavity.

20. The moveable plug assembly of claim 16, where the moveable plug assembly further comprises a rectangular prong base constructed of the electrically insulating plastic of and extending outward from the circumferential periphery of the ball-shaped moveable plug assembly to partially surround and/or at least partially support the prongs of the moveable plug assembly at a base of each prong adjacent the ball-shaped plug assembly body, the rectangular prong base extending between and coupling together the respective bases of the electrically-conductive prongs.

21. The moveable plug assembly of claim 16, where each of the electrically-conductive prongs are electrically coupled to a respective one of the opposing plug assembly electrical contact detents by a respective conductive lead that is embedded or molded within the ball-shaped plug assembly body such that each respective conductive lead extends through and is completely surrounded by the electrically insulating plastic of the rectangular prong base and ball shaped plug assembly body between one of the electrically-conductive prongs and a respective one of the plug assembly conductive detents.

22. A multi-position duckhead adapter plug, comprising:

a stationary adapter housing having a housing cavity defined therein, the stationary adapter housing comprising:

opposing stationary housing conductive features provided on respective opposing internal sidewalls of the housing cavity, each one of the housing conductive features being configured for coupling to an electrically-powered device by a respective electrical conductor, and at least one stationary housing locking feature provided on at least one back internal wall of the housing cavity; and a moveable plug assembly rotatably received within the housing cavity of the stationary adapter housing, the moveable plug assembly comprising:

a ball-shaped plug assembly body constructed of electrically insulating plastic and having a plug assembly axis of rotation that extends between opposing sides of the ball shape of the plug assembly body, one or more electrically-conductive prongs extending outwardly from the ball-shaped plug assembly body, each of the prongs being electrically coupled within the housing cavity to a respective one of the stationary housing conductive features and being configured and dimensioned for insertion into a corresponding electrically-conductive socket, and at least one plug assembly locking detent provided on the plug assembly body;

where the at least one plug assembly locking detent is configured to releasably mate with the at least one stationary housing locking feature to releasably lock the moveable plug assembly in at least one pre-determined position within the cavity of the adapter housing about the axis of rotation.

23. The adapter plug of claim 22, further comprising a semispherical recess defined within each of the two opposing internal sidewalls of the stationary adapter housing that partially receives a portion of a spherical outer surface of the movable plug assembly; and a semispherical recess defined within the back internal wall of the stationary adapter housing that partially receives a portion of a spherical outer surface of the movable plug assembly.

* * * * *